United States Patent [19]

Wiebe

[11] Patent Number: 4,895,408

[45] Date of Patent: Jan. 23, 1990

[54] RAILWAY TRUCK AND TRUCK WHEELSET AND METHOD FOR LUBRICATING A RAILWAY RAIL

[75] Inventor: Donald Wiebe, Sewickley, Pa.

[73] Assignee: A. Stucki Company, Pittsburgh, Pa.

[21] Appl. No.: 245,516

[22] Filed: Sep. 19, 1988

[51] Int. Cl.[4] ..... B61K 3/00

[52] U.S. Cl. ..... 295/34; 184/3.1

[58] Field of Search ..... 295/1, 31.1, 34; 184/3.1, 3.2; 105/463.1

[56] References Cited

U.S. PATENT DOCUMENTS

| | | | |
|---|---|---|---|
| 904,174 | 11/1908 | Briggs | 295/34 |
| 1,292,567 | 1/1919 | Beckwith | 184/3.2 |
| 1,897,827 | 2/1933 | Sullivan | 184/3.2 |
| 2,866,521 | 12/1958 | Gibson | 184/3.2 |
| 4,230,043 | 10/1980 | Aldington | 295/34 X |
| 4,294,482 | 10/1981 | Scheffel et al. | 295/31.1 X |

*Primary Examiner*—Margaret A. Focarino
*Assistant Examiner*—Dean J. Kramer
*Attorney, Agent, or Firm*—Carothers & Carothers

[57] ABSTRACT

An improved railway vehicle wheel profile and method for controlling the distribution of lubricant applied to the wheel flange in a manner to minimize contamination of the rail running surface with lubricant.

15 Claims, 3 Drawing Sheets

FIG. 4
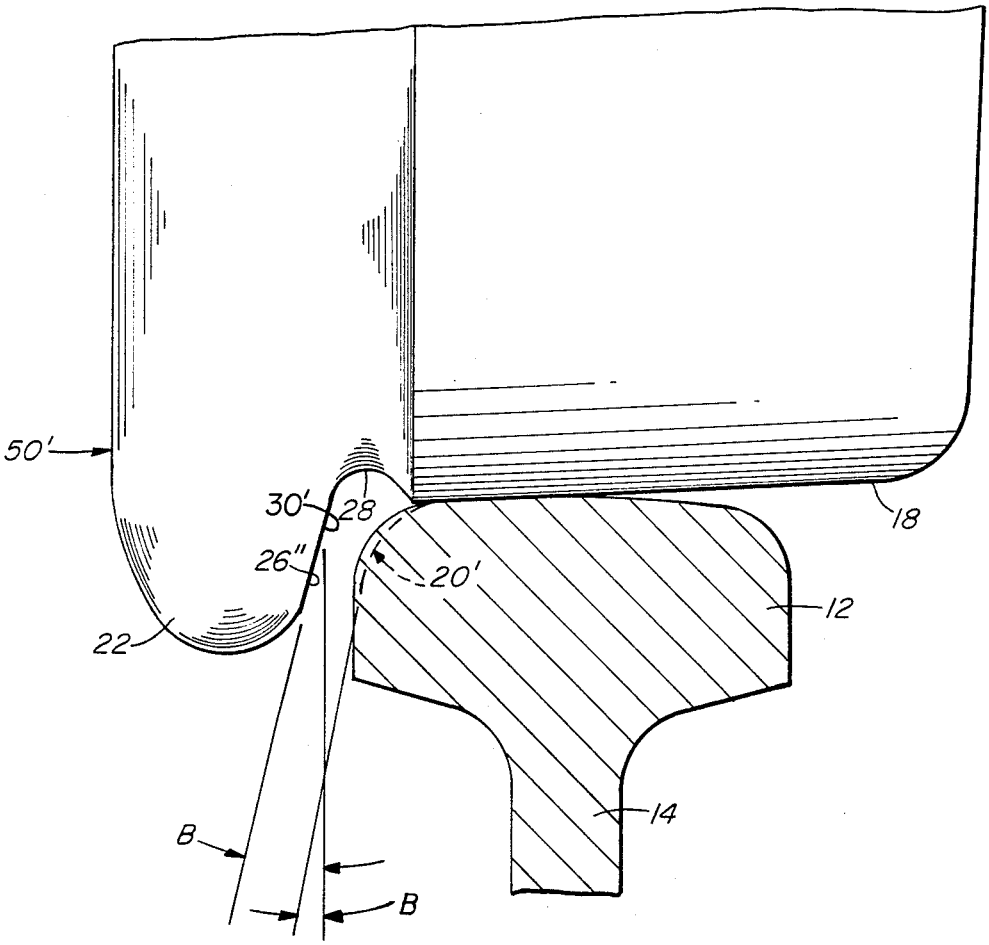
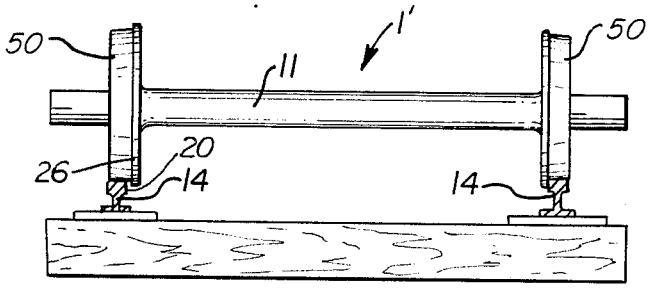
FIG. 2

RAILWAY TRUCK AND TRUCK WHEELSET AND METHOD FOR LUBRICATING A RAILWAY RAIL

BACKGROUND OF THE INVENTION

In the railway art railway trucks are provided with wheelsets which engage laterally spaced rails that are disposed at a predetermined gage or lateral spacing, measured as the distance between confronting gage surfaces on the inner sides of the rail heads of the respective rails. It is well known that the application of lubricant to the gage surface of one or both rails can significantly reduce friction and wear between the rail gage surfaces and the flanges of the truck wheelsets running on the rails without adversely affecting the friction between the mutually engaged surfaces of the wheel tread surfaces and the rail head running surface, which is required to drive a train.

It has been suggested that proper rail gage surface lubrication can provide significant operating cost savings through fuel cost savings and through extended rail and wheel service life. In order to provide gage surface lubrication, onboard (e.g. carried by a locomotive or special vehicle) and way-side lubrication systems are commonly used. The reader is referred to the art which includes detailed description of a variety of such lubrication systems as further detailed description thereof here is believed to be unnecessary for an understanding of the present invention by one skilled in the art.

Problems have arisen in the use of known gage surface lubrication systems as a result of difficulties encountered in the control of lubricant distribution. Generally, lubricant is distributed along the gage surface of a rail by the passing wheelsets of the rail car trucks. The lubricant is applied to the wheel flange surface which confronts the rail head gage surface, and is distributed by a wiping action along the rail gage surface as a result of the rolling movement of the wheel along the rail. It is important that lubricant be distributed as uniformly as possible along the rail head gage surfaces from the confronting wheel flange surfaces with a minimal spread (or lateral migration) of lubricant to the rail head running surface. However, the rolling motion of truck wheelsets along the rails is always accompanied by lateral movement of the wheel flanges between the rail gage surfaces. This lateral movement is a significant factor in causing lubricant to migrate toward the rail running surface.

Contamination of the rail running surface with lubricant introduces numerous problems, including increased difficulty of detecting rail flaws and higher L/V ratios with resultant increased potential for rail climbing by guiding wheel flanges on both freight car and locomotive trucks. Excessive lubricant application leads to accumulation of lubricant on the rail running surface as well as on truck and car body surfaces, resulting in reduced effectiveness of friction groups and resilient side bearings, reduced maximum traction and braking forces which can be extremely hazardous for train operations, and impaired electrical conductivity between the rails and wheels. While lubricant on the rail running surface reduces rail wear it thereby also increases the possibility of rail head metal fatigue and the subsequent development of transverse fatigue cracks in the rail head surface and gross rail failure.

The inherent side-to-side oscillation of typically coned rail car wheelsets on the rails will inevitably cause some lateral migration of lubricant onto the rail head running surface. This effect is aggravated on worn wheel and rail head interfaces due to closer matching of the contacting surface portions of the wheel flange and rail gage surfaces. Problems with lubricant migration can be further exacerbated by misalignment of lubricant applicators on the lubricant distributing wheelsets, which results in lubricant being applied nearer the flange throat and wheel-rail running surfaces area than desired.

BRIEF SUMMARY OF THE INVENTION

The present invention contemplates a novel and improved railway truck wheelset and wheel profile, and a novel method for application of lubricant to rail gage surface interfaces with a novel wheel profile so as to reduce the incidence of lubricant contamination on the rail running surface. The improved wheel profile will more readily accommodate misaligned lubricant dispensing nozzles and other variables which have in the past contributed to undesirable or uncontrolled patterns of lubricant distribution and resulting migration thereof onto the rail head running surface.

In one aspect, the invention contemplates a wheel in which the throat of the wheel flange is formed to provide a radially extended flange surface confronting the rail head gage surface at a selected angle and a generally arcuate transition zone blending the extended flange surface with the tread of the wheel. The resulting wheel profile, in one preferred form, has the flange throat formed as a circumferential groove having a minimum radius, measured from the axis of rotation of the wheel, which is smaller than the rolling radius of the adjacent portion of the wheel tread. The novel wheel profile is employed in lubricant applicator wheelsets of an onboard lubricating system and is effective to control lateral lubricant movement to the rail head.

The novel wheel profile encourages lubricant application to the rail gage surface only in areas thereof which ultimately minimize lubricant migration to the rail head running surface, thus affording improved modes of lubricant distribution with all of the attendant benefits as above specified. By thus limiting and controlling the initial lubricant application to the gage surface of the rail, my novel wheel and method also reduce the propensity for the following wheels, which typically are of standard configuration and will commonly have worn flanges and tread profiles, to transfer the applied lubricant laterally beyond the gage side rail head radius and onto the rail running surface.

My novel wheel profile is defined within the confines of a standard conical wheel profile with the extended flange surface and the transition surface affording the desired lubricant application enhancement and being configured to afford a sound mechanical structure according to accepted mechanical design practice and railway wheel specifications.

It is therefore one object of the invention to provide a novel and improved railway car truck wheel and wheel and axle set.

It is a further object of the invention to provide a railway truck wheel which enhances control over the movement of lubricant applied to the wheel flange for the purpose of distributing such lubricant along the rail gage surface.

A more specific object of the invention is to provide an improved rail car wheel including a radially extended flange surface confronting the rail head gage surface and a flange throat which forms a blending or transition zone between the flange and the tread surface of the wheel.

Yet another object of the invention is to provide a novel method of initially distributing the lubricant on rail head gage surfaces in a manner to limit lateral migration of the lubricant toward the rail-wheel running surface.

These and other objects and further advantages of the invention will be more fully appreciated upon consideration of the following detailed description of a presently preferred embodiment of my invention and the accompanying drawings, in which:

FIG. 2 is an elevational view of a railway truck wheelset according to one presently preferred embodiment of my invention and disposed in rolling engagement on a conventional railway track;

FIG. 4 is a view similar to FIG. 2 showing an alternative embodiment of the invention.

Figure 1:
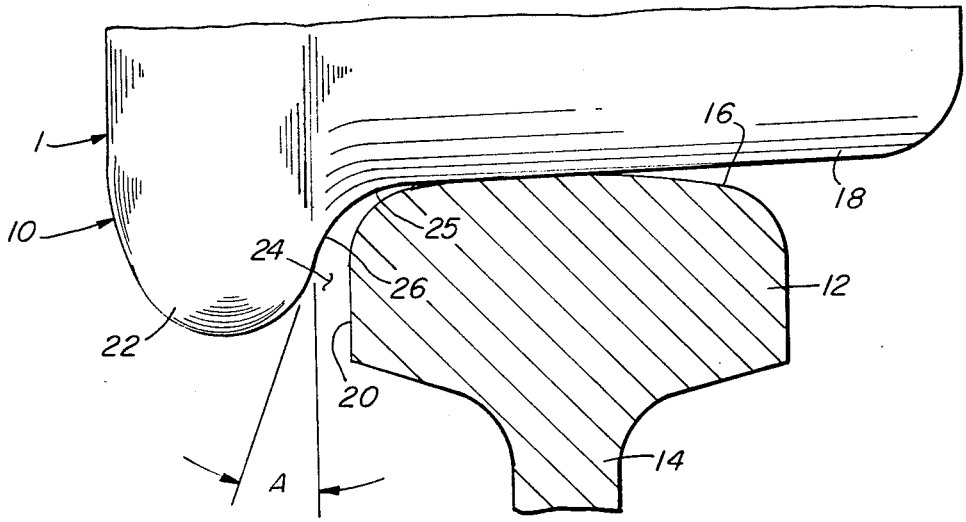
FIG. 1 (PRIOR ART)
FIG. 1 is a fragmentary portion of a prior art rail car wheel supported on a conventional rail which is shown in section on a plane perpendicular to the axis of the rail.

There is generally indicated at 1 in FIG. 1 a fragmentary portion of a rail car truck wheel and axle set including a conventional wheel 10 which is engaged upon the head 12 of a conventional rail 14 for rolling therealong in the well known manner. Rail head 12 includes a running surface 16 on which a conical tread portion 18 of wheel 10 is engaged for rolling movement along the rail 14. Rail 14 includes a gage surface 20 which is maintained in uniformly spaced relationship with respect to a corresponding gage surface of a second rail which is laterally spaced to the left of rail 14 as shown in FIG. 2.

To maintain the rolling engagement of both wheels 10 of wheelset 1 on the respective rails 14, each wheel 10 is provided with a circumferential flange portion 22 which is of a selected radius, reckoned from the axis of rotation of the wheel 10, larger than the largest rolling radius of the conical tread portion 18 to ensure that in normal operation the range of lateral movement of the wheelset 1 on the running surface 16 of the respective rails is limited to the maximum magnitude of the lateral clearance, as indicated at 24, between the gage surfaces 20 and the confronting flange portions 26 of flange portions 22. Thus, in normal operation the limit of lateral movement of the wheelset 1 is defined by the magnitude of lateral movement thereof in either lateral direction between the rails 14 before flange portions 26 of wheel flanges 22 engage the respective gage surfaces 20 as shown in FIG. 2. During such lateral movement of the wheelset, which occurs continuously during normal operation, clearance 24 will vary in magnitude between a maximum and a minimum clearance. Under normal operating conditions the minimum lateral clearance may approach or equal zero.

It is well known that the wheelsets of rail car trucks commonly will oscillate laterally owing to the operational characteristics of the conventional wheel conicity in rolling engagement with the rail running surface 16, and as a result rubbing or sliding contact between flange surface 26 and the respective rail gage surfaces 20 occurs repeatedly and periodically. On curved track such rubbing contact between guiding wheel flanges and the outside rail will be continuous. Thus, there have been proposed a number of wheel and rail lubrication schemes generally intended to lubricate the confronting flange 26 and the rail gage surfaces 20 to alleviate the adverse consequences of such rubbing engagement which include, most notably, excessive flange and rail wear and excessive fuel cost resulting from the increased rolling resistance.

Figure 3:
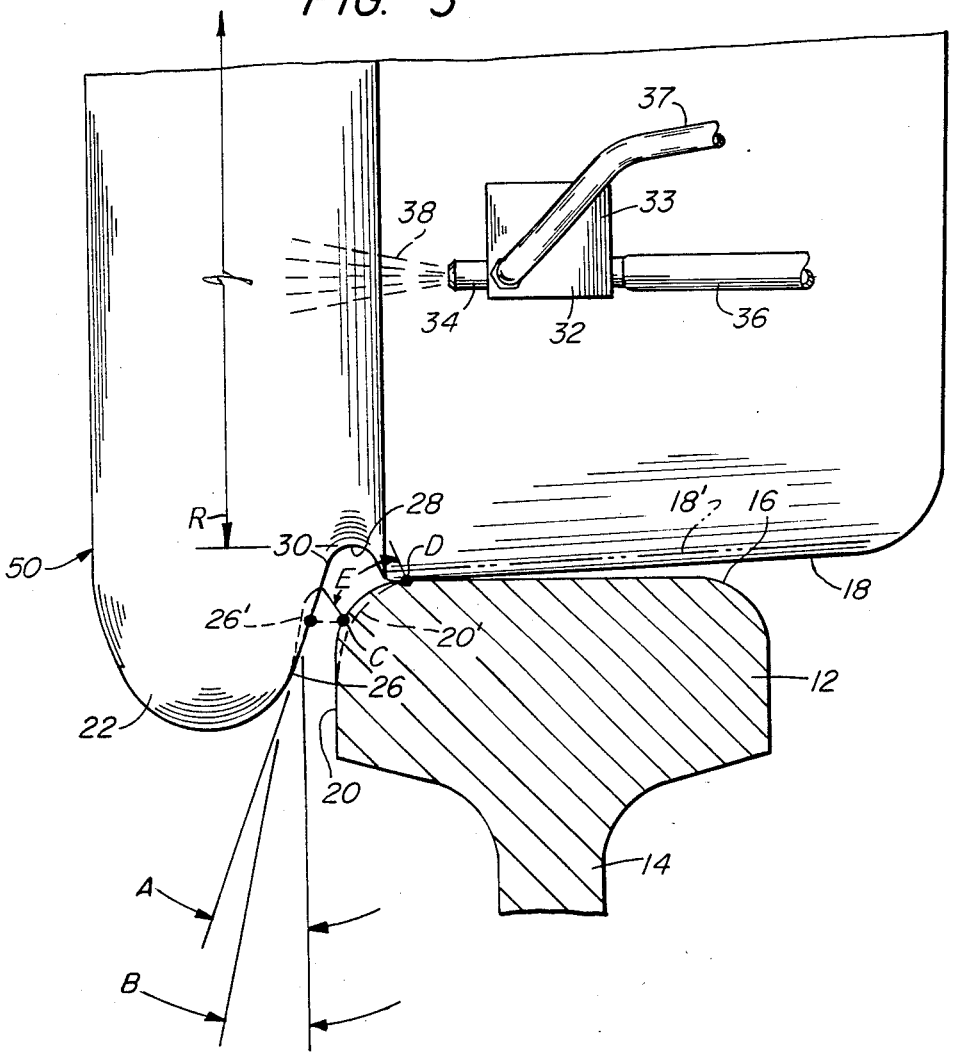
FIG. 3 is an enlarged, fragmentary portion of FIG. 2.

A conventional lubricant application assembly 32 is shown in FIG. 3 as a nozzle assembly 33 which carries a nozzle 34 positioned to dispense lubricant 38 onto a wheel flange. Lubricant is provided to nozzle assembly 33 via a lube line 36 and is applied with the assistance of compressed air provided via a compressed air line. In all lubrication systems which apply lubricant to conventional wheel flanges, a portion of the lubricant to be applied to the flange transition radius or the fillet area tends to migrate laterally therefrom onto the wheel tread surface and ultimately to contaminate the rail head running surface. This effect occurs with either new or worn conventional wheel tread and flange profiles. The process of lubricant migration onto the rail running surface will occur with progressively greater facility as the surface profiles of the flange and transition radius or throat, and the confronting surface portions of rail head, become more closely matched due to progressive wear of the conventional wheel and rail structures.

In FIG. 2 a wheelset 1' for a railway car truck comprises a pair of new or non-worn flanged wheels 50 which are rigidly affixed to an elongated axle 11 for rolling engagement on conventional rails 14. In FIG. 3, one of the wheels 50 is shown as typical of both wheels 50 and includes a wheel body having a conventional conical external tread surface portion 18 and an adjacent flange section or portion 22, the wheel 50 being adapted for rolling engagement on rail running surface 16. The flange 22 of wheel 50 includes an extension 30 of the annular flange surface 26 which faces gage surface 20. Extension 30 is joined to the wheel tread surface 18, not by a conventional flange throat portion 25 as disclosed with reference to FIG. 1, but instead by a transitional zone or surface, also referred to herein as a groove or a recess, and including a blend portion 28 formed as a circumferentially extending, radially inwardly projecting portion of the groove which is contiguous with both the extension 30 of flange surface 26 and with wheel tread portion 18. Blend surface 28 includes a minimum radius R, reckoned from the axis of rotation of wheel 50, which is less than the rolling radius of the adjacent portions of wheel tread 18. The wheel 50 thus includes a formed surface of revolution having the profile of flange surface 26, extension 30, blend portion 28 and tread 18 as above described.

The transitional zone extending between extension 30 and tread 18 serves to minimize or substantially eliminate lubricant transfer to the laterally adjacent portions of the rail head gage side radius by interrupting rail-wheel contact in the area between the point of contact C between flange surface portion 26 and gage surface 20, and the nearest adjacent point of contact D between running surface 16 and tread 18. That is, due to the radially relieved transitional zone between flange 22 and tread 18, the contact patch between the wheel and the rail head cannot move laterally along a continuously extending lateral path around the rail head gage side radius in response to lateral wheel oscillation. Such lateral migration of the contact patch is limited by the transitional zone including blend surface portion 28 and flange surface extension 30. Lubricant applied to the flange surface 30 of a rotating wheel will migrate radially outwardly thereon as a result of centrifugal force, and also as a result of gravity at many locations about the circumference of a stationary wheel. Thus, for both the rotating and the stationary wheel the primary influences producing movement of lubricant that has been applied to the wheel flange tend to move the lubricant radially outward toward and beyond the circular locus of points on the wheel flange which can engage the rail head gage surface at point C.

The lateral spacing maintained in zone E between the uppermost point of mutual contact (C) between flange surface 26 and gage surface 20 on the one hand, and between running surface 16 and tread 18 (D) on the other hand, provides a relatively large clearance between the rail head gage side surface, and the adjacent portions of flange 22 including surface 26, extension 30, and blend portion 28. As this clearance is maintained continuously, the opportunity for lubricant applied to the flange surface 26 in zone E (i.e. above point C on the rail gage surface) to be deposited on the rail by rubbing or wiping contact is substantially reduced if not eliminated entirely.

As noted, with my novel wheel structure, as with conventional flanged wheels, the centrifugal action of wheel rotation (which may be viewed as a gravitational influence) causes lubricant applied to flange 22, as shown at 38 in FIG. 3, to move radially outward on the flange surface portions 30 and 26 (and surface portion 26' for a worn wheel 50) whereby, in conjunction with the effect of the clearance provided in zone E as above described, lubricant is transferred to the rail gage surface only in areas of mutual contact or close mutual approach between gage surface 20 and flange surface 26 during lateral wheelset oscillation. Thus, for practical purposes lubricant transfer onto gage surface 20 is limited to portions of surface 20 below point C by wiping engagement thereof with adjacent lubricant bearing surface portions of flange 22.

As will be seen from the following further description, the described wheel structure is effective to more consistently direct lubricant away from the rail head running surface under all conditions including rotating and stationary wheels and at any circumferential position on the wheel. That is, under all modes of influence due to both centrifugal action and gravity, lubricant applied to the wheel flange surface tends to be transferred to the rail head primarily at or adjacent to point C (FIG. 3), or at locations below point C. The resulting advantageous control of lubricant application is rendered primarily by the inclusion of extension portion 30 of flange surface 26, with blend surface 28 having a geometry dictated by mechanical design considerations.

Blend surface 28 preferably is designed (for example, by having the apex or smallest radial distance thereof from the axis of rotation of the wheel, located axially as close as possible to the adjacent tread surface 18) so that concentrations of lubricant in the deepest part of the groove will have only a minimal amount of the lubricant concentration located on the inboard or tread surface side of the groove apex. The major portion of the lubricant will be located on the outboard or flange surface side of the groove apex.

In general, as lubricant is projected from the nozzles and directed toward the wheel flange and flange throat area, a portion of the lubricant is always prone to spread toward the flange throat area near the tread on a conventional wheel, and to then migrate past the throat region and spread onto the rail head running surface in response to lateral oscillation of the wheel. If the nozzle is directed more toward the radially outer extent of the flange to avoid lubricant migration to and past the flange throat, there is a danger of lubricant slinging radially off the flange before it can be wiped onto the gage side of the rail. A properly designed wheel in accordance with the above description can provide a repository for excess lubricant as well as a barrier to lubricant spreading unimpeded to the throat area of the flange adjacent to the wheel tread. The groove and adjacent areas according to this invention thus may be considered as a containment for lubricant in two contexts: first, as a repository or reservoir for lubricant and second, as a barrier to undesirable modes of lubricant migration. Moreover, the surface character or finish of the groove and adjacent areas which form the lubricant repository may be selected to provide enhanced containment and distribution of lubricant. For example, a knurled surface portion in or adjacent to the groove may offer enhanced lubricant retention.

The groove contour or cross-sectional shape can be so designed that the greater surface area in the groove is inclined outwardly toward the flange resulting in a greater wetted surface area for directing the major radial movement of lubricant in the groove radially outwardly on the wheel flange surface.

Under these conditions, the impetus for radially outward movement of lubricant from the deeper portions of the groove will result in most of the lubricant flowing radially outward along the flange surfaces 30 and 26 rather than toward tread surface 18. This serves to further minimize the migration of lubricant toward the interface between the wheel tread surface and the rail running surface.

With extended service, rails and railway truck wheels undergo progressive wear. Thus, wheel tread portion 18 may wear generally to a configuration as shown at 18' in FIG. 3, and the flange surface 26 and rail gage surface 20 may wear generally to profiles shown respectively at 26' and 20'. As can be seen, with sufficient wear of my novel wheel and the conventional rails on which it runs, the points C and D as above defined may approach one another, with the zone E becoming correspondingly smaller. Where my novel wheel structure is used with an onboard lubricating system for initial application of lubricant to rail gage surfaces, the wheels of other trucks following the applicator wheels also will generally exhibit varying degrees of wear consistent with the extent and conditions of the in-service use each has undergone. However, since the initial application of lubricant to the rail head gage surface will be limited to application near and below point C, subsequent lubricant distribution by a succession of passing wheels, regardless of their wear condition, will not tend to distribute lubricant toward or onto the running surface of the rail head.

As noted above, under conditions of progressive wear, points C and D can approach one another. However, with the presence of the groove 28 lubricant transfer to an elevation on the rail head gage side no higher than point C is assured for generally normal operation of the lubricant dispensing nozzles. It is therefore to be understood that the specific geometry of wheel 50, including most notably the geometric relationship between the profile of tread 18 and that of flange 22, is to be judiciously selected to ensure the described effect of controlled lubricant application and transfer will be maintained throughout the anticipated progressive wear of conventional wheel and rail structures during their normal service life. Of course, this includes selection of wheel 50 geometry with due regard to the expected variations in rail wear which are normally encountered in service.

According to the FIG. 3 embodiment, the invention may incorporate a flange surface 26 and extension 30 oriented at an angle A of 21° to the vertical, or to a line that is normal to the wheelset axis (the term vertical being used hereinbelow for convenience) so that both diverge radially and axially away from wheel tread surface 18. This is currently a standard angle of inclination for the flange of a conventional new freight car wheel profile.

Such a standard flange will tend to wear in service to an angle of inclination B, for example 12° to the vertical, after running for a time on worn rails with worn gage surfaces 20 as the gage surfaces 20 typically approach the same angle of inclination B as a result of extended service with conventional wheel profiles. Accordingly, an alternative embodiment of my invention is shown in FIG. 4 as a wheel 50' with an inclined flange surface 26'', and with extension 30', and transitional surface or zone 28 and tread portion 18 formed thereon substantially as above described with reference to FIG. 2. In the embodiment of FIG. 4, however, flange surface 26'' and extension 30' are initially inclined at angle B, for example 12°, and at least 10°, to the vertical, rather than at the standard angle A=21° of FIG. 3.

The anticipated result of this modification would be more uniform wear characteristics in service for the wheel 50' on typically worn track with improved lubricant transfer. The increased interface contact area between the flange and the worn gage surface 20' results in reduced localized wear, and consequently reduced incidence of wear-induced discontinuity in the wheel and rail profile geometry.

Figure 5:
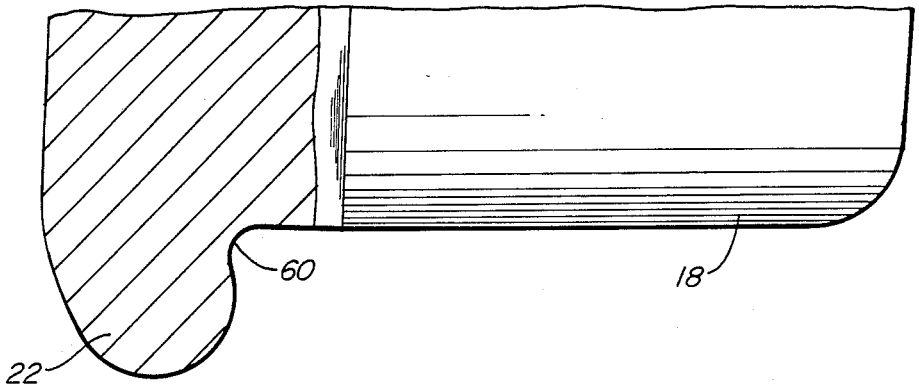
FIG. 5 is a fragmentary portion partially sectioned, of another alternative embodiment of the invention.

FIG. 5 shows a further alternative embodiment of the invention wherein the annular groove adjacent to the wheel tread surface 18 extends axially outward of tread surface 18 and not radially inward thereof so as to form an annular recess 60 which extends axially into the section profile of flange 22. FIG. 5 is intended as a generally schematic depiction. Of course, an actual groove profile for the embodiment of FIG. 5 would be structured to comply with all applicable mechanical design requirements and limitations.

Other alternative embodiments, including an annular groove or recess with combined elements of axially outward and radially inward extension with respect to the flange section and the tread radius, respectively, are also contemplated.

From the above description it will be appreciated that I have invented a novel and improved railway vehicle truck and wheel structure having a geometry which contributes considerably to effective control of rail lubricant application and distribution. The lubricant applied between the wheel flanges and the rail gage surfaces can be distributed in a more effective and controlled manner, thereby reducing the quantity of lubricant necessary for effective results and substantially reducing or eliminating the undesirable tendency for lubricant to migrate onto the rail running surface.

It will be appreciated that my invention may be applied not only to known rail car wheels, but also to hitherto undescribed wheels with anticipated effects entirely similar to those above described in the control of lubricant distribution. Most notably, the structure of this invention need not be a load bearing wheel at all but can instead be an idler wheel which functions solely as a lubricant applicator. I have contemplated these and various other alternative and modified embodiments of the invention and such would certainly also occur to those versed in the art, once apprised of my invention. Accordingly, it is intended that the invention be construed as broadly as permitted by the scope of the claims appended hereto.

I claim:

1. In an apparatus for applying lubricant to a longitudinally extending surface of a railway track rail head which is disposed laterally adjacent to the running surface of such a rail head, a lubricant applicator comprising:

a rotary member adapted for rotation about a central axis and including a surface of revolution disposed coaxially with respect to said central axis;

said surface of revolution including a tread surface for rolling engagement with such a running surface and a lubricant receiving surface disposed axially adjacent said tread surface and adapted to have such lubricant deposited thereon;

said lubricant receiving surface including a first generally annular surface portion which is adapted to be disposed in laterally adjacent confronting relationship with such a longitudinally extending surface for movement longitudinally thereof to apply the lubricant deposited thereon to such a longitudinally extending surface upon rotation of said rotary member with said tread surface in such rolling engagement; and said lubricant receiving surface further including a second generally annular surface portion disposed radially inwardly, with respect to said central axis, from said first surface portion and extending intermediate said first surface portion and said tread surface, with said second surface portion being effective to contain lubricant deposited thereon in a manner to inhibit movement of such lubricant toward said tread surface and such a rail head and to direct such lubricant, upon rotation of said rotary member, onto said first surface portion for application thereof to such a longitudinally extending surface.

2. The lubricant applicator as set forth in claim 1 wherein said first annular surface portion is disposed at an angle of inclination, with respect to the normal to the axis of rotation of said rotary member, of at least 10°.

3. The lubricant applicator as set forth in claim 2 wherein said angle of inclination is in the range of approximately 10° to approximately 21°.

4. The lubricant applicator as set forth in claim 3 wherein said angle of inclination is approximately 12°.

5. The lubricant applicator as set forth in claim 1 wherein said first annular surface portion is disposed at an angle of inclination, with respect to the normal to the axis of rotation of said rotary member, of approximately 21°.

6. The lubricant applicator as set forth in claim 1 wherein said first and second annular surface portions are mutually contiguous surfaces.

7. The lubricant applicator as set forth in claim 1 wherein said second annular surface portion includes a lubricant reservoir means.

8. The lubricant applicator as set forth in claim 7 wherein said second annular surface portion further includes a barrier means which is operable to prevent movement of such lubricant toward said tread surface.

9. The lubricant applicator as set forth in claim 8 wherein said reservoir means includes an annular groove extending radially inwardly of said tread surface.

10. The lubricant applicator as set forth in claim 1 wherein said second annular surface portion is disposed with respect to said first annular surface portion and said tread surface so as to maintain a clearance between said second annular surface portion and such a rail head throughout such rolling engagement.

11. In a railway system wherein a track is comprised of a pair of laterally spaced rails with rail heads which include a laterally disposed surface means located laterally adjacent to the running surfaces of said rail heads, respectively, and wherein the rail heads are cooperable with the respective wheels of railway truck wheelsets to limit lateral movement of the wheels in opposed lateral directions as they longitudinally traverse the track with the wheel treads in rolling engagement with the respective rail head running surfaces, a method of applying lubricant to such a laterally disposed surface of a rail head comprising:

providing such a wheel with an annular flange portion which includes a surface portion that is moveable into laterally adjacent confronting relationship with the respective laterally disposed surface means upon rotation of such a wheel in rolling engagement on the respective running surface;

applying lubricant to said surface portion;

rotating such a wheel in rolling engagement on the respective running surface to move the wheel longitudinally thereof;

in conjunction with said rotating, controlling movement of the applied lubricant on said surface portion in a manner to promote movement of said applied lubricant radially outward on said surface portion;

during said rotating, permitting only a radially outer part of said surface portion to approach the respective laterally disposed surface sufficiently closely to deposit said applied lubricant thereon from said surface portion; and continuously maintaining a predetermined relative positional relationship between the respective laterally disposed surface means and a radially inner part of said surface portion located radially inwardly of said radially outer part so as to preclude direct transfer of said applied lubricant from said radially inner part of said surface portion to portions of the respective laterally disposed surface means adjacent the respective running surface.

12. The method as set forth in claim 11 wherein said relative positional relationship includes a minimum clearance of a sufficient magnitude to preclude direct transfer of lubricant onto said laterally disposed surface throughout movement of such a wheelset both laterally and longitudinally with respect to such a track.

13. A railway truck wheel comprising:

a formed wheel member having a central axis of rotation and a coaxial circumferentially extending tread surface which is adapted to travel on the running surface of a railway rail;

said wheel member having a flange segment adjacent one axial end of said tread surface which extends, with respect to said central axis, radially outwardly of said tread surface and terminates in an outer extent, said flange segment having, with respect to said central axis, a circumferentially continuous formed surface thereon;

said formed surface having a generally annular surface section extending from a location at least adjacent said outer extent of said flange segment to said one axial end of said tread surface;

said annular surface section having a circumferentially continuous rail engaging surface portion and a transition surface section extending between a radially inner portion of said rail engaging surface portion and said one axial end of said tread surface; and said transition surface section having at least a portion thereof formed with a surface configuration which is effective during such travel of said wheel on such a railway rail to facilitate the gravitational distribution of lubricant deposited thereon to said rail engaging surface portion.

14. The railway truck wheel as set forth in claim 13 wherein said rail engaging surface portion is inclined to extend axially and radially toward said one axial end of said tread surface from a location at least adjacent said outer extent of said flange segment.

15. The railway truck wheel as set forth in claim 13 wherein said transition surface section extends radially inwardly, with respect to said central axis, of said tread surface.

* * * * *